US006000920A

United States Patent [19]

Yoshimura

[11] Patent Number: 6,000,920

[45] Date of Patent: Dec. 14, 1999

[54] OIL-FLOODED SCREW COMPRESSOR WITH SCREW ROTORS HAVING CONTACT PROFILES IN THE SHAPE OF ROULETTES

[75] Inventor: Shoji Yoshimura, Takasago, Japan

[73] Assignee: Kabushiki Kaisha Kobe Seiko Sho, Kobe, Japan

[21] Appl. No.: 08/907,486

[22] Filed: Aug. 8, 1997

[51] Int. Cl.[6] ..... F04C 18/16

[52] U.S. Cl. ..... 418/201.3

[58] Field of Search ..... 418/201.3

[56] References Cited

U.S. PATENT DOCUMENTS

| | | | |
|---|---|---|---|
| 3,666,384 | 5/1972 | Amosov et al. | 418/201.3 |
| 3,692,441 | 9/1972 | Amosov et al. | 418/201.3 |
| 4,460,322 | 7/1984 | Schibbye et al. | 418/201.3 |
| 4,575,323 | 3/1986 | Yoshimura | 418/201.2 |
| 4,890,991 | 1/1990 | Yoshimura | 418/201.3 |
| 4,989,997 | 2/1991 | Yoshimura | 384/100 |
| 5,088,907 | 2/1992 | Yoshimura | 418/201.3 |
| 5,123,822 | 6/1992 | Yoshimura | 418/201.2 |
| 5,135,374 | 8/1992 | Yoshimura et al. | 418/201.2 |

FOREIGN PATENT DOCUMENTS

| | | |
|---|---|---|
| 0 785 360 | 7/1997 | European Pat. Off. . |
| 1197432 | 7/1970 | United Kingdom . |
| WO 94/23207 | 10/1994 | WIPO . |

*Primary Examiner*—John J. Vrablik

*Attorney, Agent, or Firm*—Oblon, Spivak, McClelland, Maier & Neustadt, P.C.

[57] ABSTRACT

Radial cross sections of a male screw rotor and a female screw rotor at a contact portion therebetween for transmitting power from the female rotor to the male rotor are profiled in the shape of roulettes, for example, cycloids, generated by the rolling of rolling curves, for examples, circles, along pitch circles of the rotors.

2 Claims, 6 Drawing Sheets

OIL-FLOODED SCREW COMPRESSOR WITH SCREW ROTORS HAVING CONTACT PROFILES IN THE SHAPE OF ROULETTES

BACKGROUND OF THE INVENTION

1. Field of the Invention

The present invention relates to a screw rotor used in an oil-flooded screw compressor driven by a female rotor.

2. Description of the Related Art

Although a popular type of oil-flooded screw compressor is driven by a male rotor, an oil-flooded screw compressor driven by a female rotor to obtain a large number of revolutions is also well known. In the oil-flooded screw compressor, about 90% of input power is consumed by the male rotor and the remainder, about 10%, is consumed by the female rotor. Accordingly, in the oil-flooded screw compressor driven by the male rotor, 10% of input power is transmitted from the male rotor to the female rotor at a contact portion between tooth surfaces of the male and female rotors.

On the other hand, in the oil-flooded screw compressor driven by the female rotor, 90% of input power is transmitted from the female rotor to the male rotor at the contact portion. Therefore, much contact stress, what is called, Hertz stress acts on the contact portion, which causes pitting if the area of the contact portion is small. As is well known, when a convex tooth surface and a concave tooth surface are in contact with each other, the Hertz stress is proportional to the square root of the difference between the reciprocals of radii of curvature of the tooth surfaces. Therefore, the oil-flooded screw compressor driven by the female rotor is particularly required to minimize the Hertz stress at the contact portion, and it is important that the rotor tooth surfaces at the contact portion be equal in curvature. When the curvatures are equal, no Hertz stress arises, which makes it possible to prevent pitting.

Japanese Unexamined Patent Publication No. 60-153486 discloses a screw rotor in which tooth surfaces at a contact portion are equal in curvature. In this screw rotor, the contact portion is shaped like an arc whose center is located on a pitch circle. FIG. 4 shows this screw rotor. A tooth surface enclosed by a circle X is shaped like an arc having the center at a point O on the pitch circle. FIGS. 5 and 6 are enlarged views of the circle X shown in FIG. 4. In FIGS. 4, 5 and 6, M denotes a male rotor, F denotes a female rotor, and $P_M$ and $P_F$ denote pitch circles of the male rotor M and the female rotor F, respectively.

In this screw rotor, if the center distance between the male and female rotors M and F has no error as designed, the male and female rotors M and F are in uniform planar contact with each other over a wide range as shown in FIG. 5. It is actually impossible, however, to reduce the error to zero. If the center distance is not equal to the designed value, the rotors at the contact portion are in local contact, which is shown as point contact in radial section, as shown by the arrow Y in FIG. 6.

Therefore, in the case of the screw compressor driven by the female rotor, pitting of the screw rotor is inevitable in actuality.

SUMMARY OF THE INVENTION

With the foregoing problem in view, an object of the present invention is to provide a screw rotor for an oil-cooled screw compressor which always keeps a male rotor and a female rotor in planar contact and prevents pitting at a contact portion between the male rotor and the female rotor even if the center distance between the male rotor and the female rotor has some error.

According to the present invention, radial cross sections of a male rotor and a female rotor at a contact portion therebetween, where power is transmitted from the female rotor to the male rotor, are profiled in the shape of roulettes which are generated by the rolling of rolling curves along pitch circles of the rotors serving as bases.

Such a structure makes the curvatures of the rotors at the contact portion always equal, causes no Hertz stress, and prevents pitting at the contact portion,

DESCRIPTION OF THE PREFERRED EMBODIMENT

Figure 1:
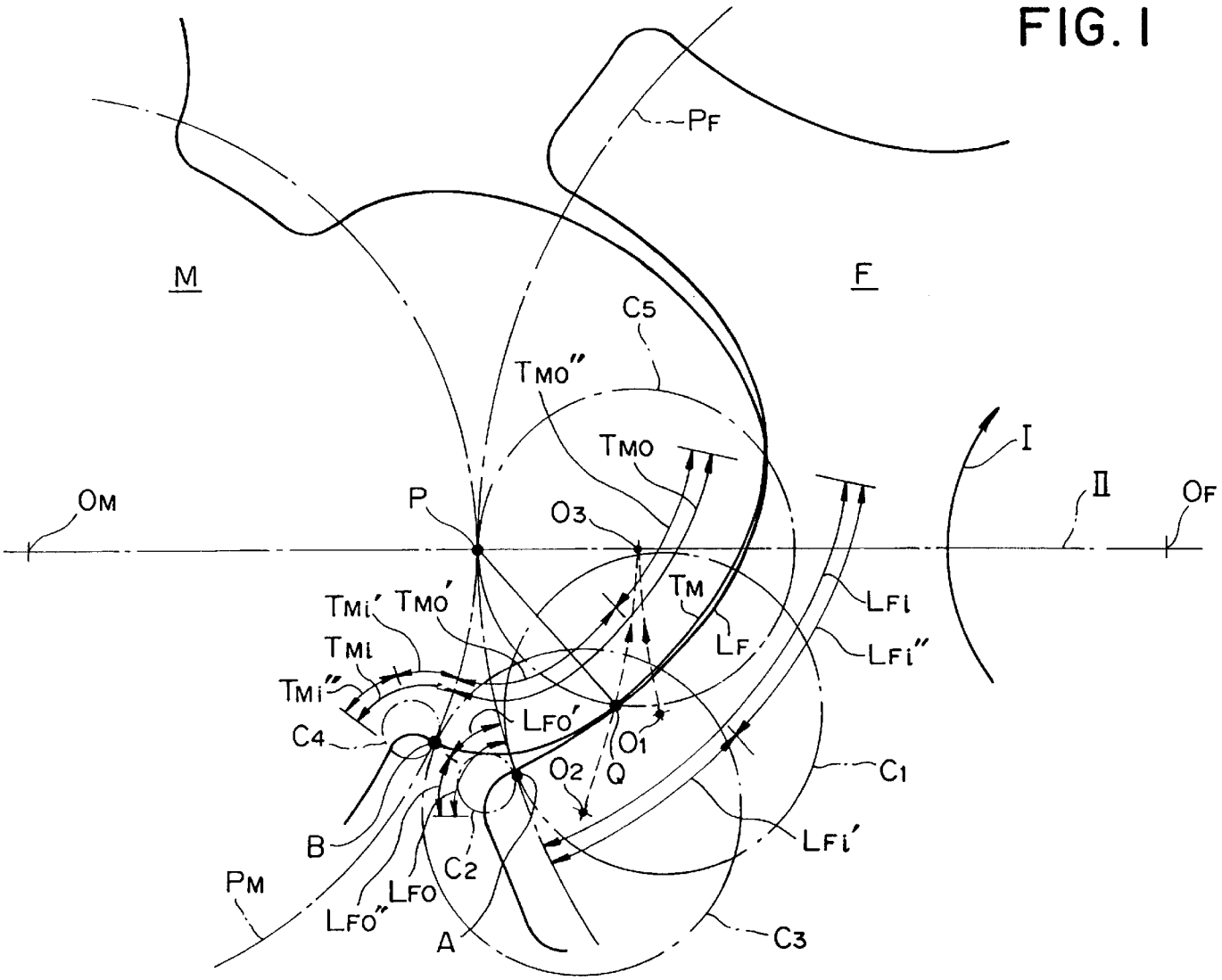
FIG. 1 is a view showing an engaging state of a screw rotor for an oil-flooded screw compressor according to the present invention.

FIG. 1 shows a screw rotor for an oil-flooded screw compressor according to the present invention. In this screw rotor, a male rotor M is driven by a female rotor F which rotates in the direction of the arrow I. In FIG. 1, $P_F$ and $P_M$ respectively denote pitch circles of the female rotor F and the male rotor M with centers $O_F$ and $O_M$, and P denotes a pitch point which corresponds to a contact point between the pitch circles $P_F$ and $P_M$, and is located on a line II linking the centers $O_F$ and $O_M$. Furthermore, $L_F$ denotes a leading tooth surface of the female rotor F including a portion for transmitting rotating power to the male rotor M, and $T_M$ denotes a trailing tooth surface of the male rotor M including a portion for receiving the rotating power from the female rotor F. The leading tooth surface $L_F$ consists of an inner portion $L_{Fi}$ inside the pitch circle $P_F$ and an outer portion $L_{Fo}$ outside the pitch circle $P_F$. Furthermore, the inner portion $L_{Fi}$ consists of a driving portion $L_{Fi'}$ for transmitting the rotating power to the male rotor M as mentioned above, and a non-driving portion $L_{Fi''}$, and similarly, the outer portion $L_{Fo}$ consists of a driving portion $L_{Fo'}$ and a non-driving portion $L_{Fo''}$. Similarly, the trailing tooth surface $T_M$ consists of an outer portion $T_{Mo}$ outside the pitch circle $P_M$ and an inner portion $T_{Mi}$ inside the pitch circle $P_M$. Furthermore, the outer portion $T_{Mo}$ consists of a driven portion $T_{Mo'}$ for receiving the rotation power from the female rotor F as mentioned above, and a non-driven portion $T_{Mo''}$. Similarly, the inner portion $T_{Mi}$ consists of a driven portion $T_{Mi'}$ and a non-driven portion $T_{Mi''}$.

The inner driving portion $L_{Fi'}$ of the leading tooth surface $L_F$ is a locus of a point A, an intersection of the leading tooth surface $L_F$ and the pitch circle $P_F$, located on a circle $C_1$, which is an example of a rolling curve inscribed in the pitch circle $P_F$ at the point A, when the circle $C_1$ rolls along the inside of the pitch circle $P_F$ serving as the base. Furthermore, the outer driving portion $L_{Fo'}$ of the leading tooth surface $L_F$ is a locus of the point A located on a circle $C_2$, which is an example of a rolling curve circumscribing the pitch circle $P_F$ at the intersection A, when the circle $C_2$ rolls along the outside of the pitch circle $P_F$ serving as the base. In other words, the contact portions, $L_{Fi'}$ and $L_{Fo''}$, are roulettes drawn by the point A when the rolling curves $C_1$ and $C_2$ roll along the pitch circle $P_F$ serving as the base. The inner non-driving portion $L_{Fi''}$ of the leading tooth surface $L_F$ is an arbitrary curve smoothly connected to the driving portion $L_{Fi'}$. Similarly, the outer non-driving portion $L_{Fo''}$ of the leading tooth surface $L_F$ is an arbitrary curve smoothly connected to the driving portion $L_{Fo'}$.

On the other hand, the outer driven portion $T_{Mo'}$ of the trailing tooth surface $T_M$ is a locus of a point B, an intersection of the trailing tooth surface $T_M$ and the pitch circle $P_M$, located on a circle $C_3$, which is an example of a rolling curve circumscribing the pitch circle $P_M$ at the intersection B and having the same diameter as the circle $C_1$, when the circle $C_3$ rolls along the outside of the pitch circle $P_M$ serving as the base. Furthermore, the inner driven portion $T_{Mi'}$ of the trailing tooth surface $T_M$ is a locus of the point B located on a circle $C_4$, which is an example of a rolling curve inscribed in the pitch circle $T_M$ at the intersection B and having the same diameter as the circle $C_2$, when the circle $C_4$ rolls along the inside of the pitch circle $P_M$ serving as the base. Similarly to the foregoing description, the contact portions, $T_{Mo'}$ and $T_{Mi'}$, are roulettes drawn by the point B when the rolling curves $C_3$ and $C_4$ roll along the pitch circle $P_M$ serving as the base. The outer non-driven portion $T_{Mo''}$ of the trailing tooth surface $T_M$ is a generating curve of the non-driving portion $L_{Fi''}$ smoothly connected to the driven portion $T_{Mo'}$. Similarly, the inner non-driven portion $T_{Mi''}$ of the trailing tooth surface $T_M$ is a generating curve of the non-driving portion $L_{Fo''}$ smoothly connected to the driven portion $T_{Mi'}$.

In this embodiment, since circles are used as rolling curves, the foregoing roulettes are also cycloids.

As shown in FIG. 1, when the leading tooth surface $L_F$ and the trailing tooth surface $T_M$ are contacted with each other at an arbitrary point Q, a curve AQ is formed by the rolling of the circle $C_1$ with a center $O_1$ to the position of a circle $C_5$ with a center $O_3$ inscribed in the pitch circle $P_F$ at the pitch point P, and a line segment PQ is the normal to the leading tooth surface $L_F$ at the point Q, and corresponds to the radius of curvature. Furthermore, a curve BQ is formed by the rolling of the circle $C_3$ with a center $O_2$ to the position of the circle $C_5$ with the center $O_3$, and the line segment PQ is the normal to the trailing tooth surface $T_M$ at the point Q, and corresponds to the radius of curvature. This means that the curvatures of the leading tooth surface $L_F$ and the trailing tooth surface $T_M$ at the contact portion therebetween are always equal to each other. Therefore, in the case in which the male rotor M is driven by the female rotor F as shown in FIG. 1, no Hertz stress acts on the contact portion and pitting is prevented.

Since the point Q is an arbitrary point, the above description is applicable wherever the leading tooth surface $L_F$ and the trailing tooth surface $T_M$ are in contact with each other.

Figure 2:
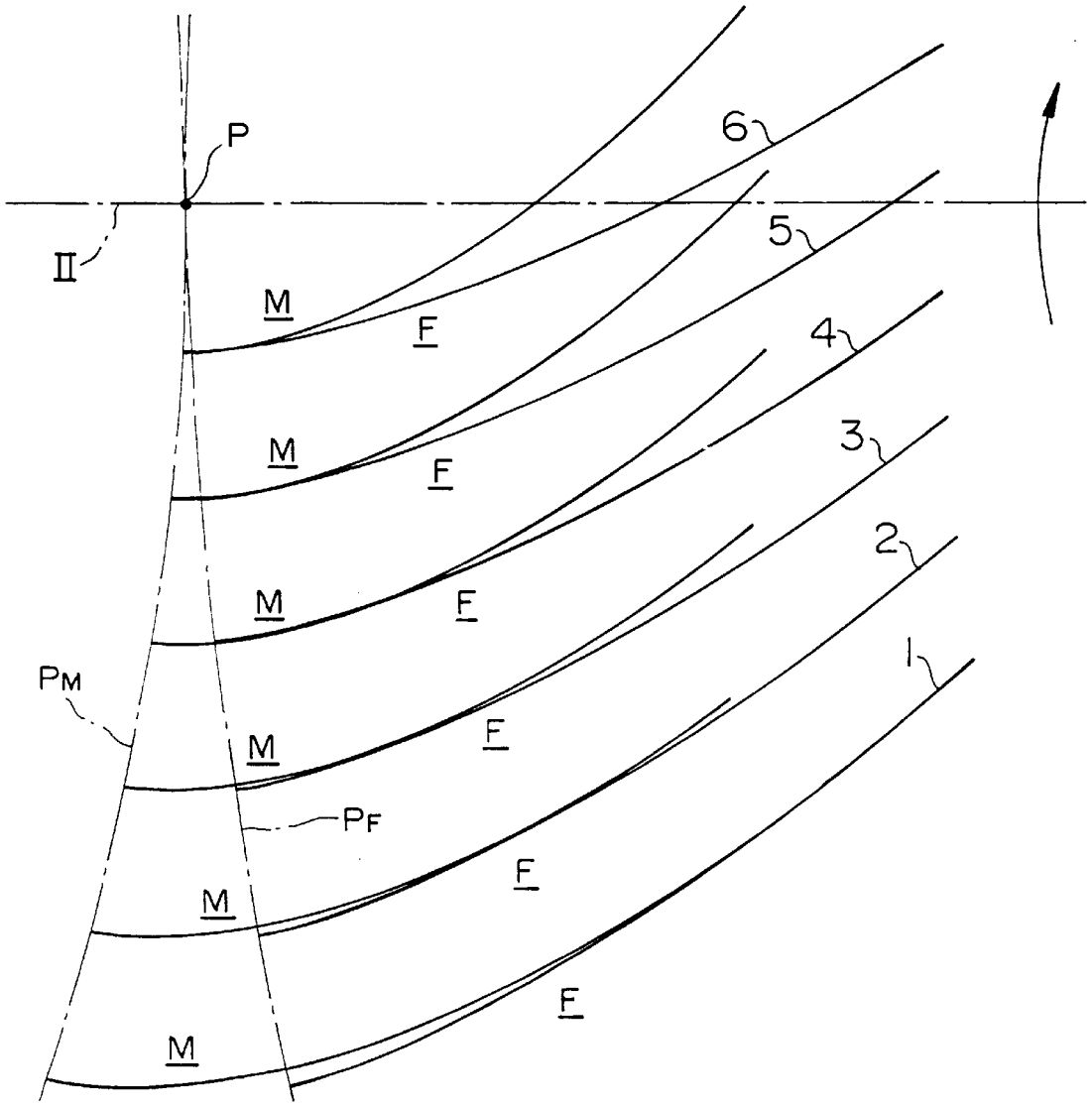
FIG. 2 is a view showing changes with time in the contact portion of a male rotor and a female rotor shown in FIG. 1 in a case in which the center distance between the male and female rotors is kept errorless as designed.

FIG. 2 shows changes with time of the contact portion between the male rotor M and the female rotor F when the distance between the centers $O_M$ and $O_F$ of the male rotor M and the female rotor F shown in FIG. 1 is kept errorless as designed. The contact portion changes from (1) to (6) in this order.

Figure 3:
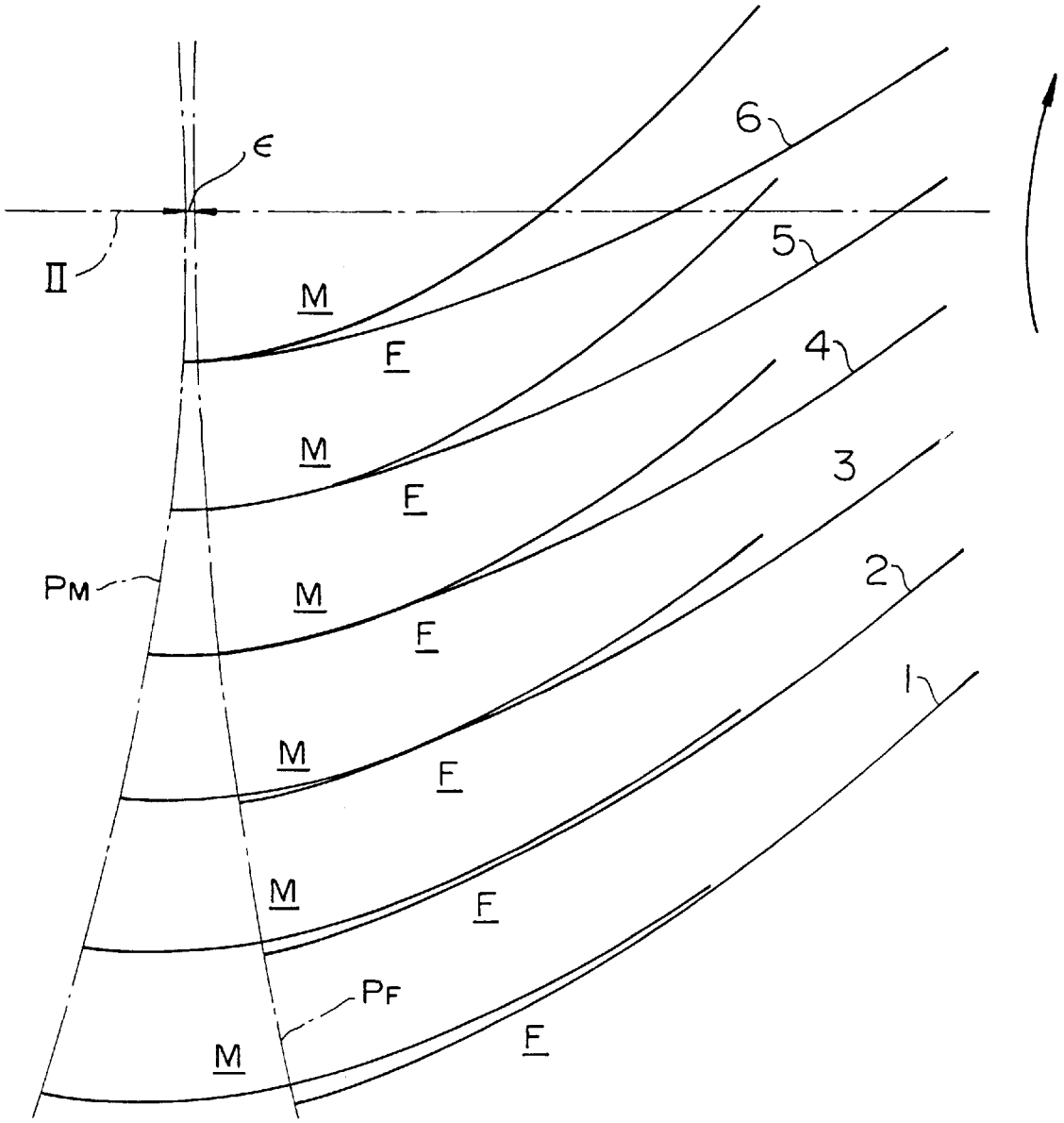
FIG. 3 is a view showing changes with time in the contact portion of the male and female rotors shown in FIG. 1 in a case in which the center distance between the male and female rotors is not equal to a designed value, that is, has an error.
Figure 4:
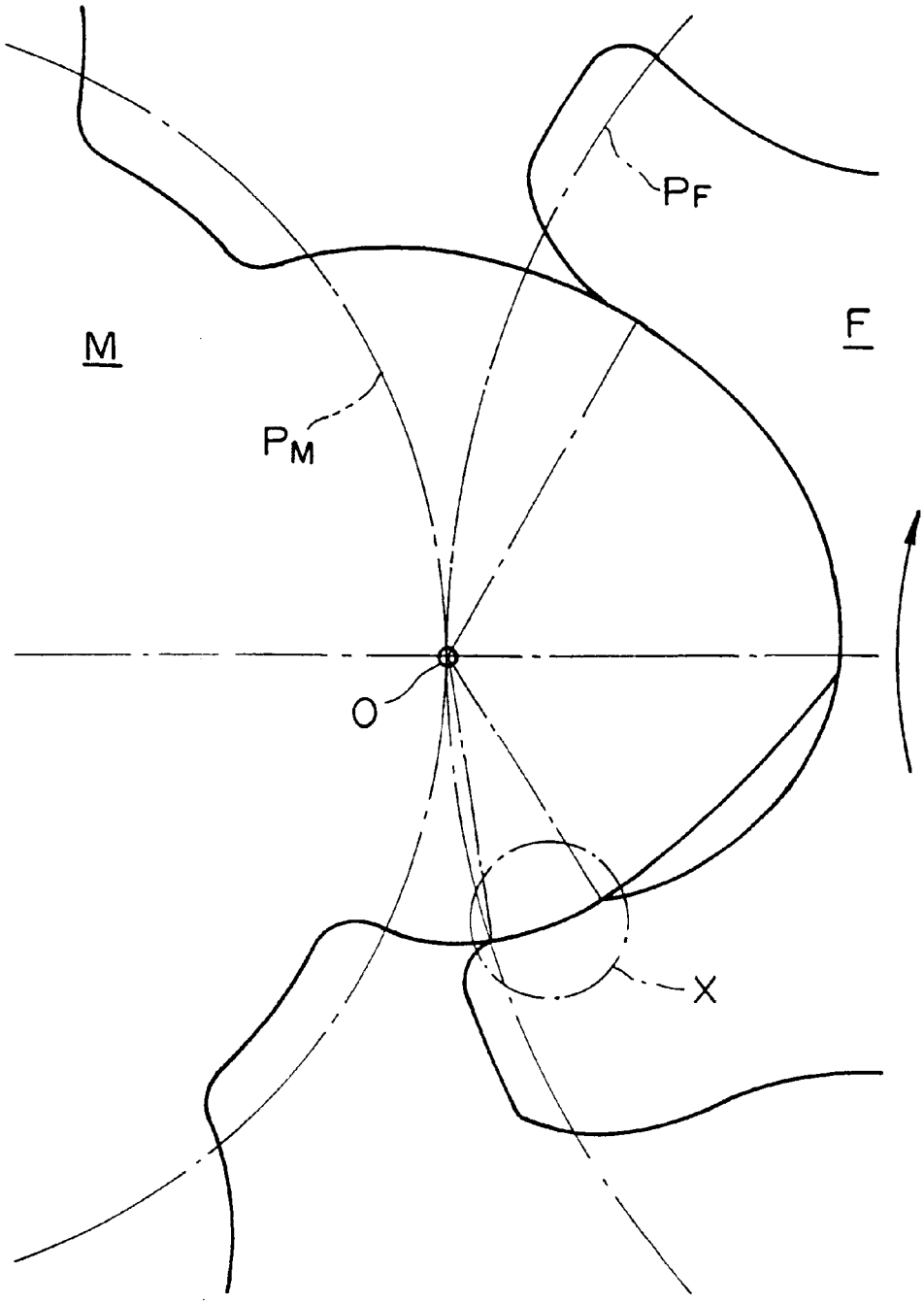
FIG. 4 PRIOR ART
FIG. 4 is a view showing an engaging state of a conventional screw rotor for a screw compressor.
Figure 5:
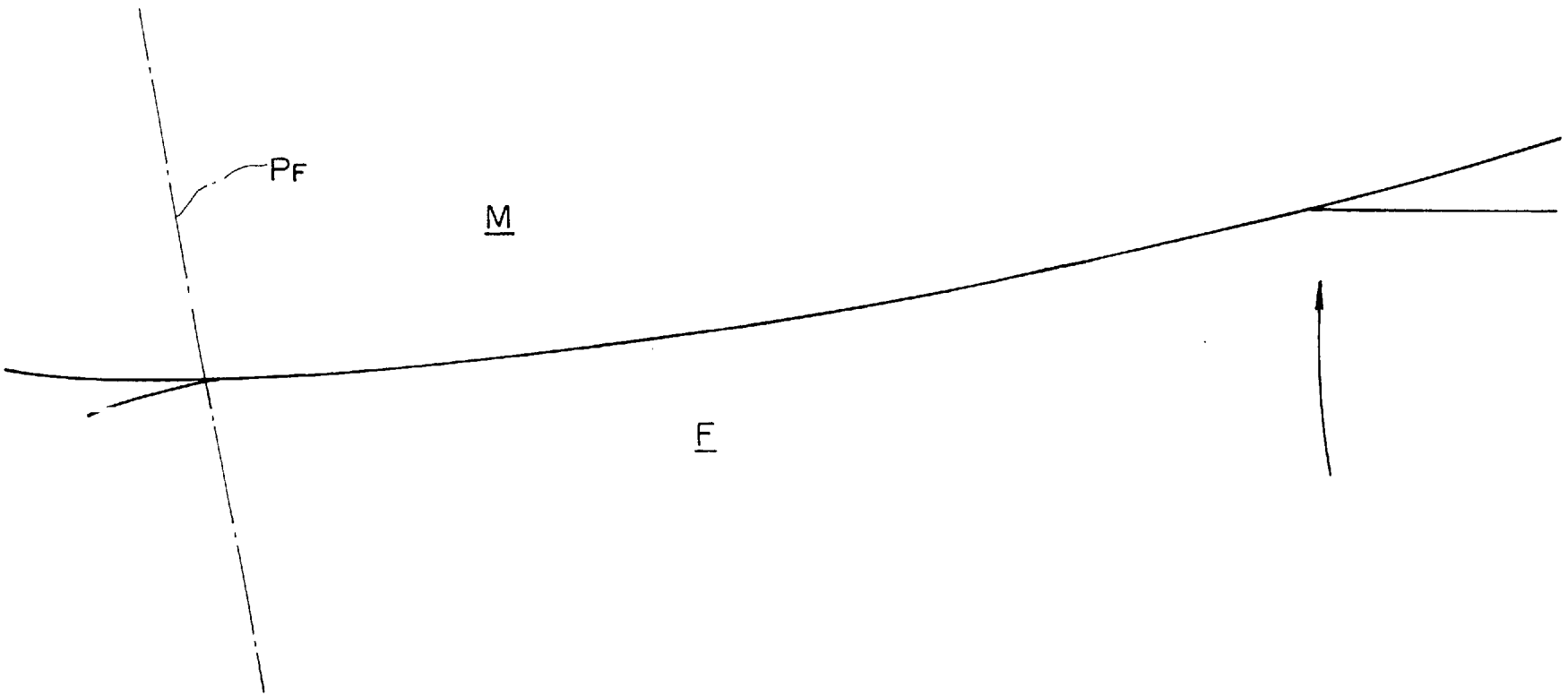
FIG. 5 PRIOR ART
FIG. 5 is a view showing a contact portion of a male rotor and a female rotor shown in FIG. 4 in a case in which the center distance between the male and female rotors is kept errorless as designed.
Figure 6:
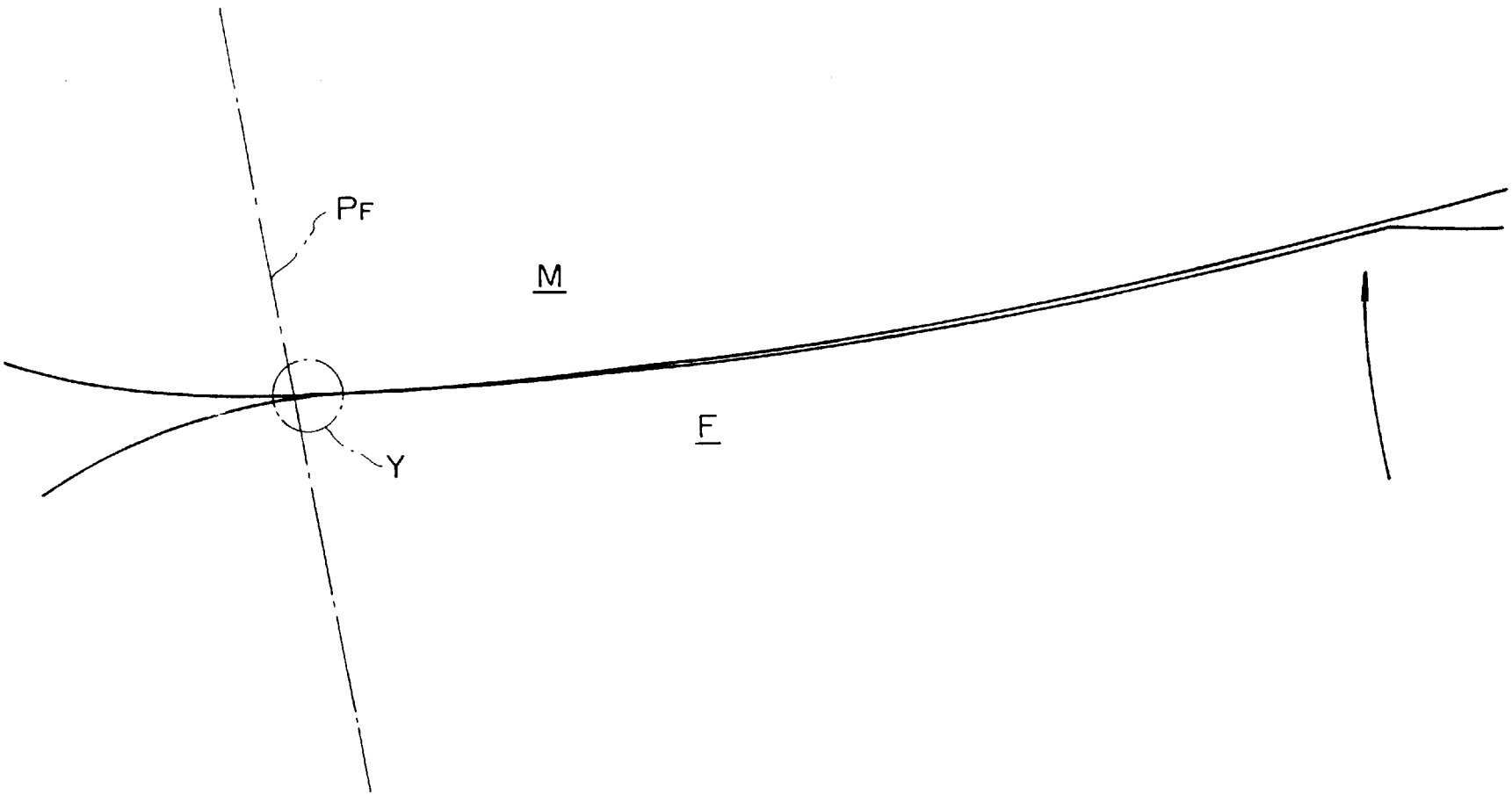
FIG. 6 PRIOR ART
FIG. 6 is a view showing a contact portion of the male and female rotors shown in FIG. 4 in a case in which the center distance between the male and female rotors is not equal to a designed value, that is, has an error.

FIG. 3 shows changes with time of the contact portion between the male and female rotors M and F when the distance between the centers $O_M$ and $O_F$ of the male and female rotors M and F shown in FIG. 1 is unequal to the designed value and has an error $\epsilon$. The contact portion changes from (1) to (6) in this order.

The male rotor M and the female rotor F in this embodiment are not brought into local contact as in the above-mentioned conventional screw rotor whether the distance between the centers $O_M$ and $O_F$ has an error or not, the male and female rotors M and F are always in uniform planar contact, and pitting is prevented from being caused at this portion.

Although the rolling curve is a circle in the foregoing screw rotor, the present invention is not limited to such a screw rotor, and also includes screw rotors in which closed curves other than a circle are used as rolling curves.

What is claimed is:

1. An oil-flooded screw compressor comprising a driving female rotor and a driven male rotor, wherein radial cross sections of the female rotor inside of a pitch circle thereof at a contact portion for transmitting power to said male rotor from said female rotor are profiled in the shape of roulettes generated by the rolling of rolling curves along the inside of said pitch circle, and radial cross sections of the male rotor outside of a pitch circle thereof at the contact portion is profiled in the shape of roulettes generated by the rolling of rolling curves along the outside of the pitch circle of the male rotor.

2. An oil-flooded screw compressor of claim 1, wherein the radial cross sections of the female rotor outside of the pitch circle thereof at the contact portion is profiled in the shape of roulettes generated by the rolling of a rolling curve along the outside of said pitch circle of the female rotor, and the radial cross sections of the male rotor of inside of the pitch circle thereof at the contact portion is profiled in the shape of roulettes generated by the rolling of a rolling curve along the inside of said pitch circle of the male rotor.

* * * * *